United States Patent [19]

Grisham et al.

[11] Patent Number: 4,888,924

[45] Date of Patent: Dec. 26, 1989

[54] DOOR FRAME EXTENSION ASSEMBLY

[76] Inventors: Fred A. Grisham, 4130 Bartlett Country Rd., Bartlett, Tenn. 38134; C. Lynwood Grisham, 9016 Anderton Springs Dr., Memphis, Tenn. 38133

[21] Appl. No.: 304,424

[22] Filed: Jan. 31, 1989

[51] Int. Cl.[4] ..... E06B 1/04
[52] U.S. Cl. ..... 52/217; 49/505
[58] Field of Search ..... 52/217, 210, 211; 49/505, 468

[56] References Cited

U.S. PATENT DOCUMENTS 3,553,891 1/1971 Casebolt et al. ..... 52/217 X

*Primary Examiner*—Carl D. Friedman
*Attorney, Agent, or Firm*—Walker & McKenzie

[57] ABSTRACT

A door frame assembly for being positioned between the edge of a door and the edge of a door opening in a wall. The assembly includes a door frame member for being attached to the door opening; and shim structure for being positioned between the door frame member and the edge of the door opening to reduce the space between the door frame member and the edge of the door.

6 Claims, 2 Drawing Sheets

DOOR FRAME EXTENSION ASSEMBLY

BACKGROUND OF THE INVENTION

1. Field of the Invention

The present invention relates, in general, to a door frame extension assembly for allowing a single size door to be used with a plurality of different size door openings.

2. Information Disclosure Statement

A preliminary patentability search in class 49, subclass 505 disclosed the following patents which may be relevant to the present invention: Coco, U.S. Pat. No. 1,496,525; Backman, U.S. Pat. No. 2,595,506; Jackson, U.S. Pat. No. 2,914,817; Parker, U.S. Pat. No. 3,060,522; Evans, U.S. Pat. No. 3,224,152; Maldonado, U.S. Pat. No. 3,906,671; Powell et al, U.S. Pat. No. 4,453,346; Baus, U.S. Pat. No. 4,611,947 and Ingold, U.S. Pat. No. 4,713,922. None of the above patents disclose or suggest the present invention. For example, none of the above patents disclose or suggest a door frame assembly for being positioned between the edge of a door and the edge of a door opening in a wall and including a door frame member for being attached to the door opening; and shim means for being positioned between the door frame member and the edge of the door opening to reduce the space between the door frame member and the edge of the door.

SUMMARY OF THE INVENTION

The present invention is directed toward providing an improved door frame extension assembly for allowing a single size door to be used with a plurality of different size door openings.

The door frame assembly of the present invention includes a door frame member for being attached to the door opening; and shim means for being positioned between the door frame member and the edge of the door opening to reduce the space between the door frame member and the edge of the door.

One object of the present invention is to provide a frame assembly for a metal security door or the like that is adjustable to fit various size door openings.

Another object of the present invention is to vary the size of a door opening using one or more shim members in combination with a door frame member.

DESCRIPTION OF THE PREFERRED EMBODIMENT

The door frame extension assembly 11 of the present invention is used between a door 13 and a door opening 17 in a wall 19 of a building or the like.

Figure 1:
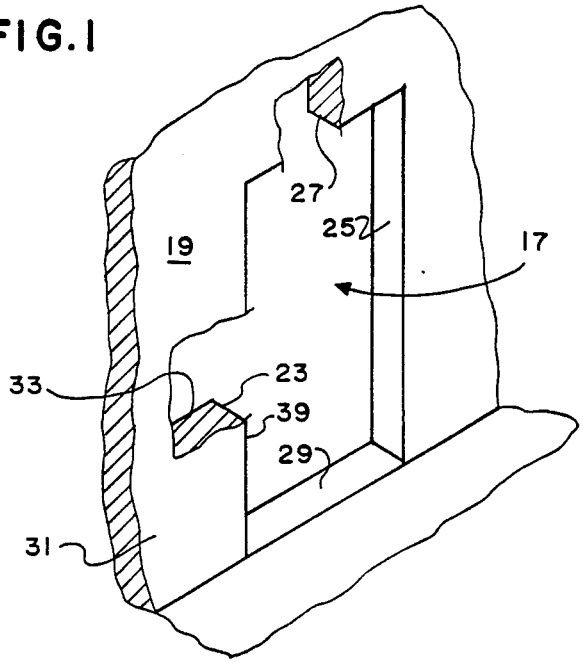
FIG. 1 is a perspective view of a wall having a door opening therein with portions thereof broken away for clarity.
Figure 2:
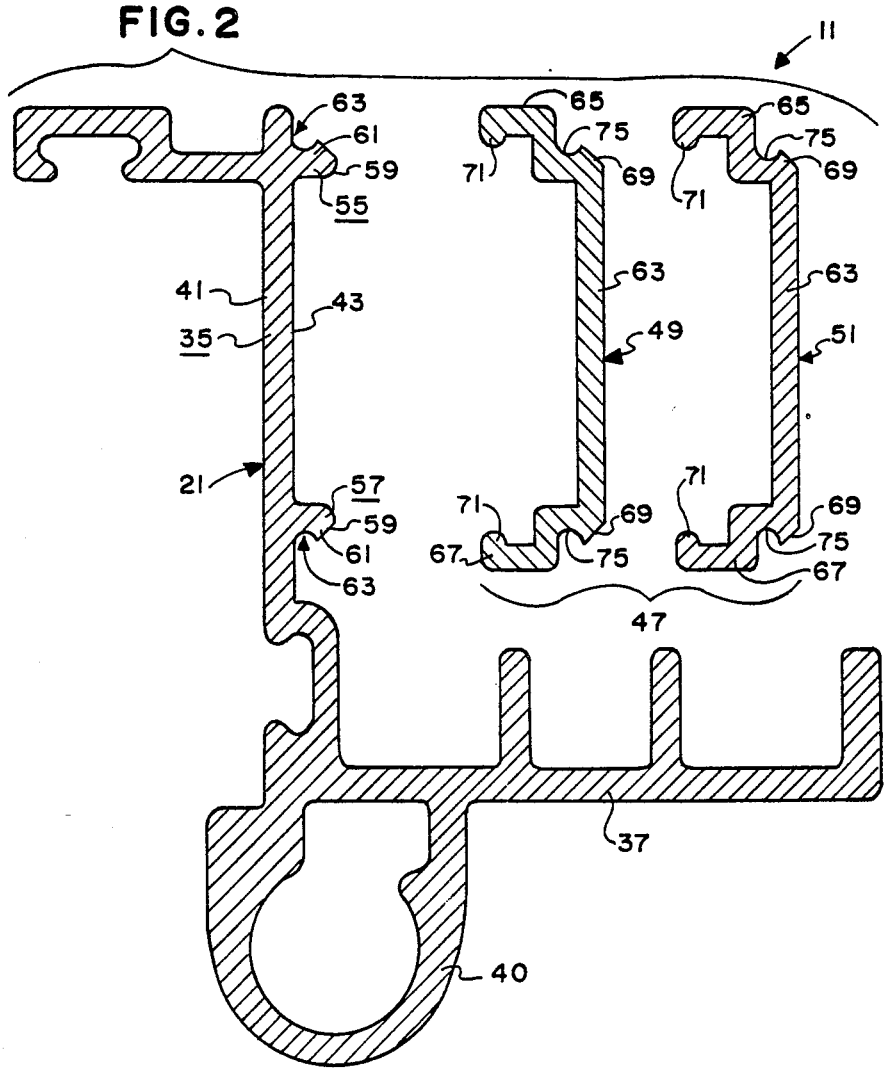
FIG. 2 is an exploded sectional view of the door frame extension assembly of the present invention.

The assembly 11 includes a door frame member 21 for being attached to the wall 19 at the door opening 17. More specifically, the door opening 17 is typically defined by a substantially vertical first jamb 23, a substantially vertical second jamb 25, a substantially horizontal header 27 extending between the upper ends of the jambs 23, 25, and a substantially horizontal sill or threshold 29 extending between the lower ends of the jambs 23, 25. The wall 19 has a first side 31 and a second side 33 and the jambs 23, 25 and header 27 extend between the first and second sides 31, 33 of the wall 19 as clearly shown in FIG. 1. The door frame member 21 preferably extends the entire length of the first and second jambs 23, 25 and the header 27 as will now be apparent to those skilled in the art.

Figure 3:
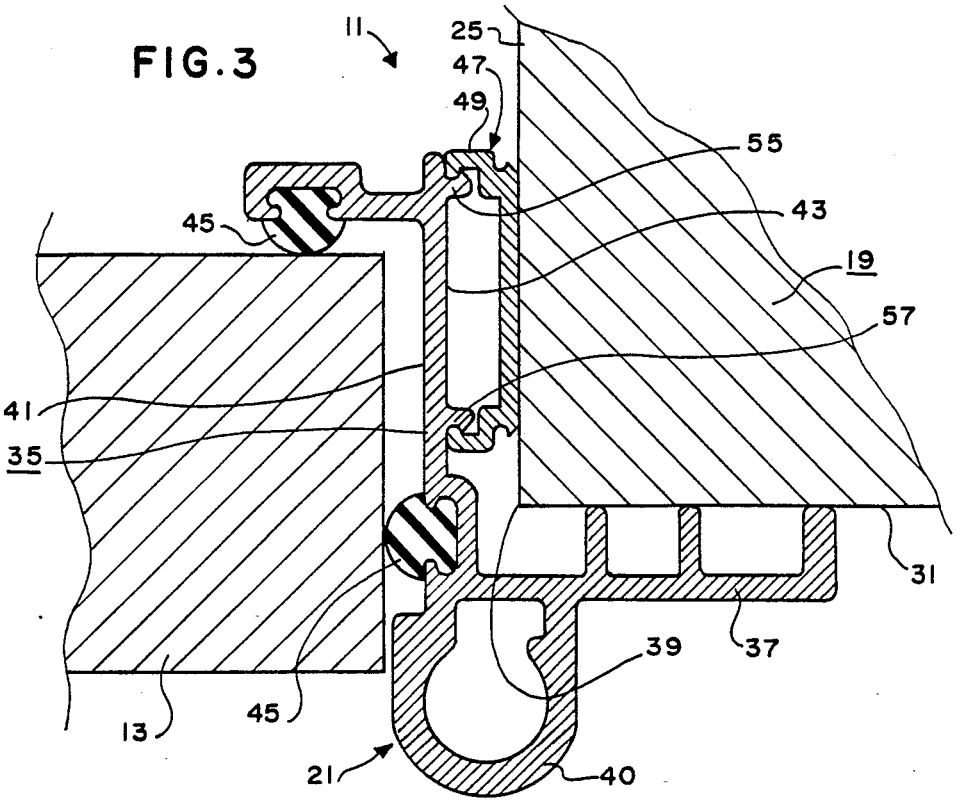
FIG. 3 is a sectional view of the door frame extension assembly of the present invention in combination with a door and a door opening in a wall.
Figure 4:
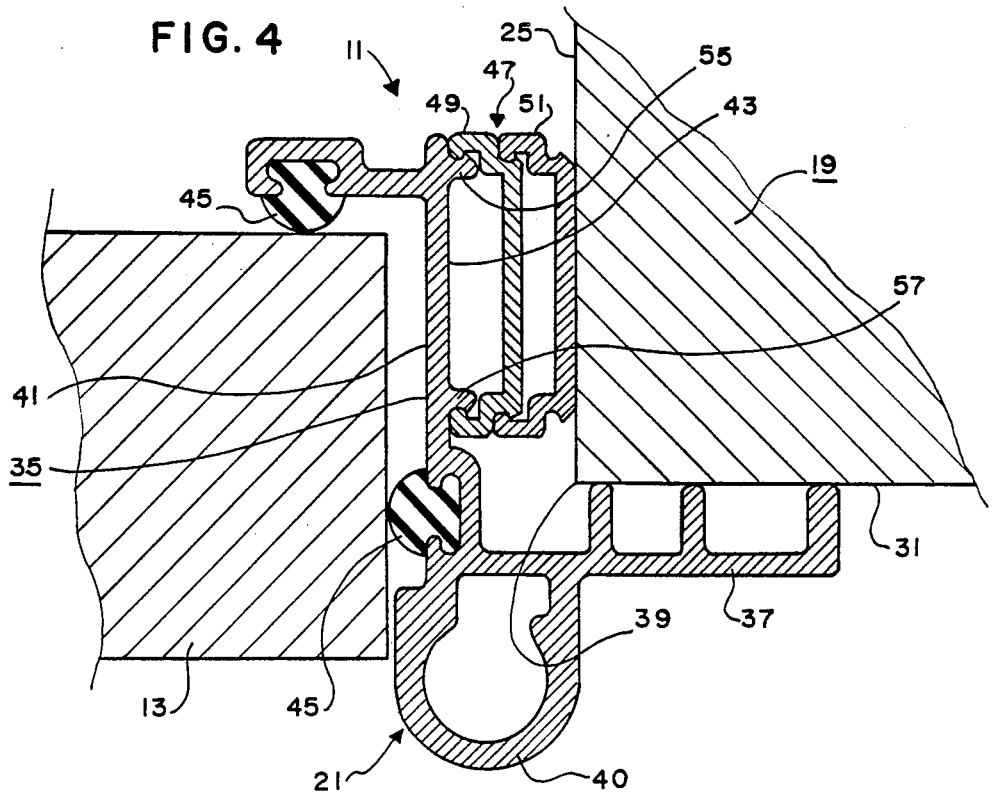
FIG. 4 is a sectional view similar to FIG. 3 but showing a modified door frame extension assembly.

The door frame member 21 preferably has a first arm 35 for covering at least a portion of the door opening 17 and a second arm 37 for covering at least a portion of the wall 19. More specifically, when viewed in cross section, the first and second arms 35, 37 are joined to one another at one edge with a 90 degree angle or the like therebetween so that the door frame member 21 can cover one corner 39 formed by the junction of the door opening 17 with the wall 19 as clearly shown in FIGS. 3 and 4. A raised, hollow bead 40 is preferably provided at the junction between the first and second arms 35, 37 for reasons now apparent to those skilled in the art. The first arm 35 has an outer side 41 and an inner side 43. Weather stripping means 45 is attached to the outer side 41 of the first arm 35 for abutting the door 13 and forming a weather-tight seal with the door 13 when the door 13 is closed as shown in FIGS. 3 and 4 and as will now be apparent to those skilled in the art.

The assembly 11 includes shim means 47 for being positioned between and abutting the inner side 43 of the first arm 35 of the door frame member 21 and the jambs 23, 25 or header 27 to insure a proper fit between the weather stripping means 45 and the door 13 regardless of the size of the door 13 and door opening 17. The shim means 47 preferably includes at least a first shim member 49 and a second shim member 51.

The assembly 11 preferably includes snap means for allowing the first shim member 49 to be snapped onto the door frame member 21 and for allowing the second shim member 51 to be snapped onto the first shim member 49.

The door frame member 21 preferably includes projection means on the inner side 43 of the first arm 35 of the door frame member 21 for either abutting the jambs 23, 25 or header 27 or a shim member 49. The projection means preferably includes a first projection member 55 and a second projection member 57. Each projection member 55, 57 is a mirror image of the other and includes a rounded outer end or head 59 and an outer side having a substantially V-shaped protrusion 61 adjacent the head 59 and a substantially semispherical groove 62 between the V-shaped protrusion 61 and the proximal end of the respective projection members 55, 57 for allowing the first shim member 49 to be snapped thereon to thereby secure the first shim member 49 to the door frame member 21.

The first and second shim members 49, 51 are identical to one another. Each shim member 49, 51 has a substantially flat face 63, a first leg 65 at one end of the face 63, and a second leg 67 at the other end of the face 63. A V-shaped projection 69 is located at each end of the face 63 sized and shaped identical to the V-shaped protrusion 61 of the projection means of the door frame member 21. Each leg 65, 67 has an inwardly directed semispherical protrusion or rounded head 71 on the distal end thereof and an outwardly directed substantially semispherical groove 75 between the V-shaped protrusion 69 and the rounded head 71. The V-shaped protrusion 69 and semispherical groove 75 are identical in size and shape to the V-shaped protrusion 61 and semispherical groove 62 while the semispherical protrusion 71 is a mirror image in size and shape to the semispherical grooves 62, 75 to allow the first shim member 49 to be snapped-fitted onto the door arm member 21 and to allow the second shim member 51 to be snapped-fitted onto the first shim member 49 as clearly shown in FIG. 4 and as will now be apparent to those skilled in the art.

The snap means of the assembly 11 is thus defined by the specific shape of the heads 59, protrusions 61, and grooves 62 of the projection means of the door frame member 21 and the protrusions 69, heads 71 and grooves 75 of the shim means 47 as will now be apparent to those skilled in the art.

The door frame member 21 and shim means 47 may be manufactured in various manners and out of various materials as will now be apparent to those skilled in the art. For example, the door frame member 21 may be extruded out of aluminum or the like and the shim means 47 may be constructed out of plastic or the like.

The operation and use of the assembly 11 is quite simple. When mounting the door 13 to the door opening 17, the door 13 and door opening 17 are accurately measured. If the gap between the door 13 and the respective jambs 23 and 25 is too great to be taken up by the door frame member 21 alone, then one or more shim members of the appropriate sizes are snapped onto the door frame member 21 as will now be apparent to those skilled in the art. It should be understood that the thickness of the individual shim members of the shim means 47 may vary to provide a greater range of gap-filling potential.

Although the present invention has been described and illustrated with respect to a preferred embodiment and a preferred use therefor, it is not to be so limited since modifications and changes can be made therein which are within the full intended scope of the invention.

I claim:

1. A door frame assembly for being positioned between the edge of a door and the edge of a door opening in a wall; said assembly comprising:

(a) a door frame member for being attached to the door opening;

(b) shim means for being positioned between said door frame member and said edge of said door opening to reduce the space between said door frame member and said edge of said door; said shim means including a first shim member for being attached to said door frame member and a second shim member for being attached to said first shim member; and (c) snap means for allowing said first shim member to be snapped onto said door frame member and for allowing said second shim member to be snapped onto said first shim member.

2. A door frame assembly for being positioned between the edge of a door and the edge of a door opening in a wall; said assembly comprising:

(a) a door rame member for being attached to the door opening; and (b) shim means for being positioned between said door frame member and said edge of said door opening to reduce the space between said door frame member and said edge of said door; said shim means including a first shim member for being attached to said door frame member and a second shim member for being attached to said first shim member; said door frame member including projection means for abutting said first shim member; said projection means including a first projection member and a second projection member, each projection member being a mirror image of the other; each of said projection members having a substantially V-shaped protrusion on the distal end thereof and a substantially semispherical groove between said V-shaped protrusion and the proximal end thereof.

3. The assembly of claim 2 in which said first shim member has a substantially flat face, a first leg at one end of said face, and a second leg at the other end of said face; each leg having an outer side and an inner side; said outer side of each of said legs having a V-shaped protrusion on the proximal end thereof for being snapped-fitted into said substantially semispherical groove of a respective one of said projection members to secure said first shim member to said door frame member.

4. The assembly of claim 3 in which the outer side of each of said legs of said first shim member has a substantially semispherical groove between said V-shaped protrusion and said distal end thereof.

5. The assembly of claim 4 in which said second shim member has a substantially flat face, a first leg at one end of said face, and a second leg at the other end of said face; each leg having an outer side and an inner side; said outer side of each of said legs having a V-shaped protrusion on the proximal end thereof for being snapped-fitted into said substantially semispherical groove of a respective one of said legs of said first shim member to secure said second shim member to said first shim member.

6. The assembly of claim 5 in which said door frame member has first and second arms joined to one another at one edge with a 90 degree angle.

* * * * *